United States Patent [19]

Sasaki

[11] 4,334,508

[45] Jun. 15, 1982

[54] INTERNAL COMBUSTION ENGINE HAVING AN ENGINE DRIVEN OIL PUMP

[75] Inventor: Hiroshi Sasaki, Iwata, Japan

[73] Assignee: Yamaha Hatsudoki Kabushiki Kaisha, Iwata, Japan

[21] Appl. No.: 74,510

[22] Filed: Sep. 11, 1979

[30] Foreign Application Priority Data

Sep. 12, 1978 [JP] Japan ..... 53-112637

[51] Int. Cl.[3] ..... F02F 7/00

[52] U.S. Cl. ..... 123/195 A; 123/198 C

[58] Field of Search ..... 123/196 R, 198 C, 195 A; 184/6.5, 6.28; 417/364

[56] References Cited

U.S. PATENT DOCUMENTS

| | | | |
|---|---|---|---|
| 2,874,804 | 2/1959 | Haas | 123/196 R |
| 2,879,758 | 3/1959 | Scheiterlein et al. | 123/195 A |
| 2,882,884 | 4/1959 | Scheiterlein | 123/195 A |
| 4,114,586 | 9/1978 | Fujikawa et al. | 123/198 C |

FOREIGN PATENT DOCUMENTS

| | | | |
|---|---|---|---|
| 979766 | 12/1975 | Canada | 123/198 C |

*Primary Examiner*—Craig R. Feinberg
*Assistant Examiner*—Andrew M. Dolinar
*Attorney, Agent, or Firm*—Fleit & Jacobson

[57] ABSTRACT

An engine includes a crankcase and a crankshaft extending in the crankcase and having one end projecting from the crankcase. A driving pulley assembly is mounted on the projecting end of the crankshaft. The crankcase is formed at the end adjacent to the pulley assembly with a gear housing section having a sideward opening. A gear casing having an oil pump mounted thereon is attached to the gear housing section at the sideward opening. A gear mechanism is provided in the gear housing section and the gear casing for driving the oil pump.

10 Claims, 4 Drawing Figures

INTERNAL COMBUSTION ENGINE HAVING AN ENGINE DRIVEN OIL PUMP

The present invention relates to internal combustion engines and more particularly to oil pump driving arrangement for internal combustion engines.

In two stroke engines, it has been a conventional practice to supply lubricant oil into the intake passage so that the oil is passed into the crankcase and the combustion chamber by being suspended in the intake mixture. For the purpose, such engines are equipped with oil pumps which are driven by the crankshafts of the engines.

In general, two stroke engines for snow mobiles have driving pulleys mounted at one ends of the crankshafts for transmitting driving efforts to the driven sprockets or wheels of the vehicles and, at the other ends of the crankshafts, there are provided several accessories such as recoil-starters and flywheel magnetos. In this type of two stroke engines, it is inconvenient to provide a power take-off for driving the oil pump at the side where the accessories are mounted so that such power take-off must be provided at the other side, that is, the side where the driving pulley is mounted. However, problems have been encountered in providing the power take-off for the oil pump at the driving pulley side because such pulley is located as close to the crankcase as possible for the purpose of decreasing the engine length. Further, since the pulley is of a substantial diameter, it has been quite difficult to mount the oil pump and its driving gear arrangements between the crankcase and the driving pulley.

In Japanese utility model publication No. Sho 51-53382 published on Dec. 21, 1976, there is disclosed an oil pump driving mechanism which includes a pump driving gear casing having a thin portion adapted to be positioned between the engine crankcase and the driving pulley and secured to the crankcase. At the side portion of the gear casing, there is mounted an oil pump casing so that the oil pump is driven by the engine crankshaft through the gear mechanism housed in the gear casing. The arrangement as proposed is found inconvenient in maintenance and adjustment of the oil pump because removal and reinstallation of the oil pump driving gear casing have not been possible without removing the driving pulley. Further, removal of the oil casing from the gear casing has been difficult since the oil casing is located too close to the crankcase.

It is therefore an object of the present invention to provide an oil pump mounting and driving arrangement in which oil pump driving mechanism can be conveniently located between the engine crankcase and the driving pulley and which provides ready removal and reinstallation of the oil pump.

Another object of the present invention is to provide an oil pump mounting and driving mechanism which is suitable for an engine having a driving pulley at one end of the crankshaft.

According to the present invention, the above and other objects can be accomplished by an internal combustion engine comprising a crankcase, a crankshaft provided in said crankcase and having one end extending outwardly from the crankcase, a driving pulley assembly mounted on said one end of the crankshaft, a power take-off gear housing section provided at an end of the crankcase adjacent to said pulley assembly, said gear housing section having an opening at a position sidewardly apart from said crankshaft, casing means removably mounted on said gear housing section at said opening and containing oil pump means, gear means extending between said gear housing section and said casing means through said opening for transmitting a driving power from said crankshaft to said oil pump means. The gear housing section may be formed integrally with the crankcase or alternatively made separately and thereafter secured to the crankcase.

According to the arrangement of the present invention, the casing means containing the oil pump means can readily be removed sidewardly from the gear housing section with the driving pulley mounted in position. Thus, the arrangement is convenient in maintenance and adjustment of the oil pump.

The above and other objects and features of the present invention will become apparent from the following descriptions of a preferred embodiment taking reference to the accompanying drawings, in which.

Figure 1:
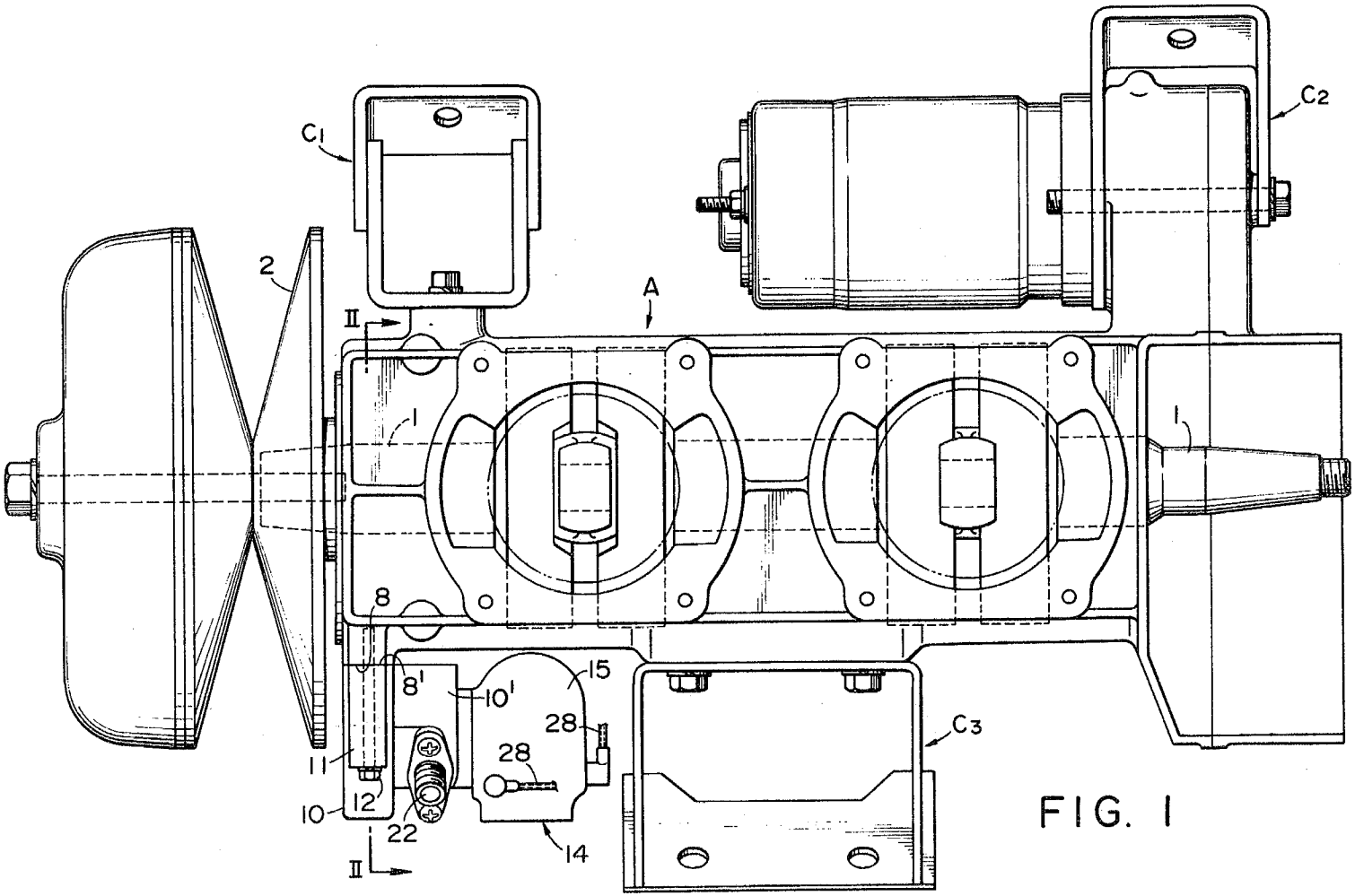
FIG. 1 is a plan view of the crankcase having an oil pump mounting and driving mechanism in accordance with one embodiment of the present invention.
Figure 2:
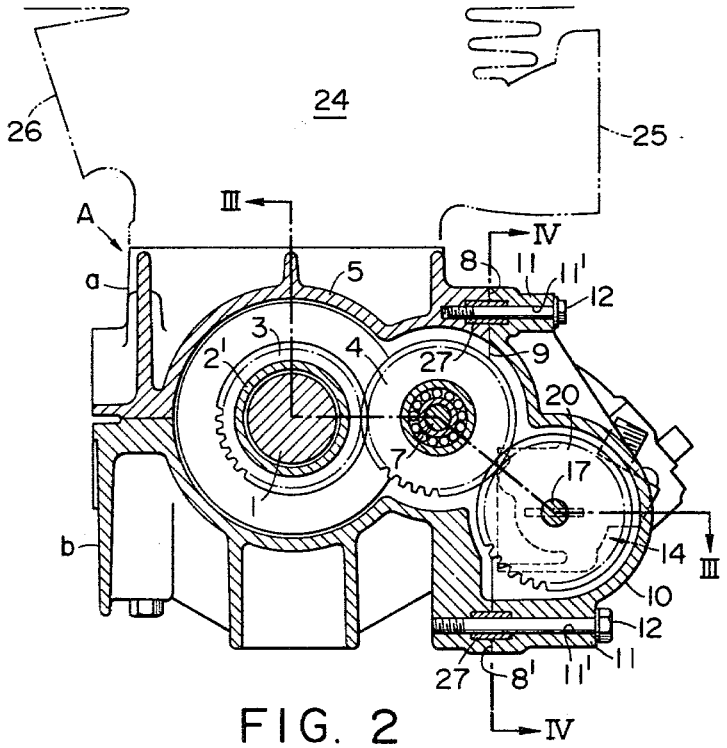
FIG. 2 is a sectional view taken substantially along the line II—II in FIG. 1.

Referring now to the drawings, the two stroke engine shown therein includes cylinders 24 having intake ports 25 and exhaust ports 26 as shown in FIG. 2. Beneath the cylinders 24, there is provided a crankcase A comprised of an upper half a and a lower half b. The crankcase A is mounted on a vehicle frame (not shown) through stays $C_1$, $C_2$ and $C_3$.

A crankshaft 1 is provided in the crankcase A and extends longitudinally. The crankshaft 1 has one end extending outwardly from the crankcase A and a driving pulley assembly 2 is mounted on the crankshaft 1 at said end. The other end of the crankshaft 1 may be used for connection with a recoil starter and a flywheel magneto (not shown). The crankcase A is integrally provided at the end adjacent to the pulley assembly 2 with a driving gear housing section 5 to which an end cap 6 is fitted to define a gear compartment.

Figure 3:
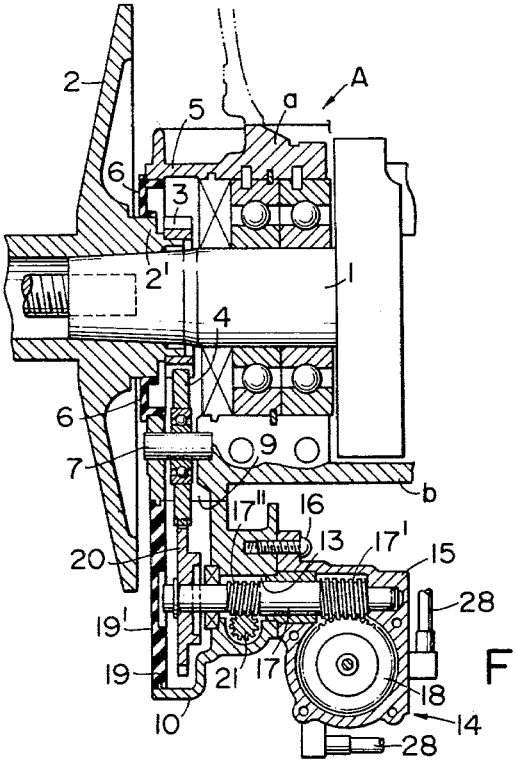
FIG. 3 is a sectional view taken substantially along the line III—III in FIG. 2; and, FIG. 4 is a sectional view taken substantially along the line IV—IV in FIG. 2.
Figure 4:
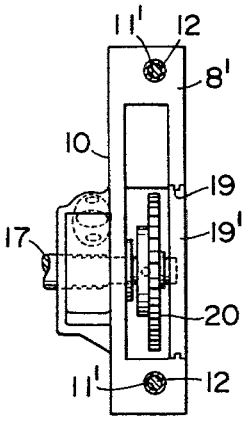

As shown in FIG. 3, the pulley assembly 2 has an axially projecting boss portion 2' for mounting the pulley assembly 2 on the crankshaft 1. An oil pump driving gear 3 is provided in the gear compartment and mounted on the outer periphery of the boss portion 2' so that the gear 3 rotates with the sheave assembly 2. In the gear compartment, there is further provided an idler gear 4 which is mounted on a counter shaft 7 and in meshing engagement with the gear 3.

The gear housing section 5 formed integrally with the crankcase A has a substantially vertical planar mounting surface 8 formed at one side thereof. In the mounting surface 8, there is formed a substantially rectangular opening 9 through which a part of the idler gear 4 projects from the gear housing section 5. A gear casing 10 is mounted removably on the housing section 5 at the mounting surface 8. The gear casing 10 has a planar mounting surface 8' which is adapted to be mated with the surface 8 on the gear housing section 5. In the mounting surface 8', there is formed an opening which is adapted to be aligned with the opening 9.

The gear casing 10 is formed with a suitable number of bulged portions 11 through which bolt holes 11' are drilled. The gear casing 10 is thus mounted on the crankcase A by inserting mounting bolts 12 through the bolt holes 11 into the crankcase A. Conveniently the bulged portions 11 are so formed that the heads of the mounting bolts 12 are located sidewardly apart from the crankshaft 1 so that access to the bolt heads is not disturbed by the pulley assembly 2.

The gear casing 10 is formed with a bore 13 which extends substantially parallelly with the crankshaft 1. The gear casing 10 is mounted at the side opposite to the pulley assembly 2 with an oil pump 14. The oil pump 14 has a pump casing 15 which is attached by means of bolts 16 to the gear casing 10. The oil pump 14 further has a pump shaft 17 which extends through the bore 13 and is rotatably supported by the gear casing 10 and the pump casing 15. In the pump casing 15, there is provided a worm wheel 18 which is in meshing engagement with a worm 17' formed on the shaft 17 and adapted for driving a pump member (not shown).

The shaft 17 has a driven gear 20 which is secured thereto at the end in the gear casing 10. The driven gear 20 is engaged with the idler gear 4 so that the pump shaft 17 is driven by the engine crankshaft 1 through the gears 3, 4 and 20. The gear casing 10 is provided with an opening 19 at the side facing to the pulley assembly 2 so that installation of the gear 20 is made therethrough. A cap 19' is attached to the housing 10 to close the opening 19.

In assembly operation, the gear casing 10 is mounted with the oil pump 14 and the pump shaft 17, and the driven gear 20 is mounted on the shaft 17. Then, the gear casing 10 is attached to the crankcase A with the driven gear 20 in engagement with the idler gear 4.

In the illustrated embodiment, the pump shaft 17 is further formed with a worm 17'' which is meshed with a gear 21 for driving a tachometer generator (not shown). For mounting the gear casing 10, the crankcase A may have locating pins 27 embedded therein so that the bores 11' in the gear casing 10 are fitted to the locating pins 27 to determine the position of the casing 10.

It will be understood that in the illustrated structure, the removal and reinstallation of the oil pump 14 can readily be made by simply removing and installing the bolts 12. It is unnecessary to remove the pulley assembly 2 for the removal and reinstallation of the oil pump 14. In the illustrated embodiment, the gear housing section 5 is formed integrally with the crankcase A, however, it may be provided separately from and thereafter attached to the crankcase A. Further, the oil pump casing 15 may be integral with the gear casing 10.

The invention has thus been shown and described with reference to a specific embodiment. It should be noted however that the invention is in no way limited to the details of the illustrated arrangement but changes and modifications may be made without departing from the scope of the appended claims.

I claim:

1. A two stroke engine for a snow mobile comprising a crankcase, a crankshaft provided in said crankcase and having one end extending outwardly from the crankcase, a driving pulley assembly mounted on said one end of the crankshaft adapted for transmitting driving force to a driven member of the snow mobile, a power take-off gear housing section provided at an end of the crankcase adjacent to said pulley assembly, said gear housing section having a first opening at a position sidewardly apart from said crankshaft, casing means removably mounted through bolt means extending substantially perpendicularly to said crankcase on said gear housing section at said first opening and containing a second opening aligned with said first opening and oil pump means, said bolt means being accessible when said driving pulley assembly is mounted on said one end of the crankshaft so as to permit removal and installation of said casing means while said driving pulley assembly is mounted on said one end of the crankshaft, and gear means extending between said gear housing section and said casing means and having a driving gear extending into said casing means through said second opening for transmitting a driving power from said crankshaft to said oil pump means, said oil pump means including a driven gear in meshing engagement with said driving gear and extending through said first opening into said gear housing section.

2. An engine in accordance with claim 1 in which said gear housing section is formed integrally with the crankcase.

3. An engine in accordance with claim 1 in which said casing means includes a gear casing attached to the gear housing section and an oil pump casing mounted on the gear casing and containing an oil pump mechanism.

4. An engine in accordance with claim 3 which includes a pump shaft extending through the gear and pump casings for driving the pump mechanism in the pump casing, said pump shaft being adapted to be driven by said driven gear.

5. An engine in accordance with claim 4 in which said gear means includes a first gear driven by the crankshaft, and an idler gear engaged with the first gear and forming said driving gear for said driven gear.

6. A two stroke engine for a snow mobile comprising a crankcase; a crankshaft provided in said crankcase and having one end extending outwardly from the crankcase; a driving pulley assembly mounted on said one end of the crankshaft adapted for transmitting driving force to a driven member of the snow mobile; a power take-off gear housing section provided at an end of the crankcase adjacent to said pulley assembly, said gear housing section having a first opening at a position facing outwardly from an axis of said crankshaft; casing means removably mounted on said gear housing section at said first opening and having a second opening aligned with said first opening and containing oil pump means; bolt means for removably mounting said casing means on said gear housing section, said bolt means being accessible when said driving pulley assembly is mounted on said one end of said crankshaft so that said casing means is removable from said gear housing section when said driving pulley assembly is mounted on said one end of said crankshaft; and gear means extending between said gear housing section and said casing means through said openings for transmitting a driving power from said crankshaft to said oil pump means, said oil pump means including a shaft, and a driven gear supported by said shaft in driving engagement with said gear means, said casing means having a third opening formed therein aligned with said shaft for insertion therethrough of said driven gear, at least a portion of said third opening being contiguous with said second opening.

7. An engine in accordance with claim 6 in which said gear housing section is formed integrally with the crankcase.

8. An engine in accordance with claim 6 in which said casing means includes a gear casing attached to the gear housing section and an oil pump casing mounted on the gear casing and containing an oil pump mechanism.

9. An engine in accordance with claim 8 in which said pump shaft extends through the gear and pump casings for driving the pump mechanism in the pump casing.

10. An engine in accordance with claim 9 in which said gear means includes a first gear driven by the crankshaft, and an idler gear engaged with the first gear and forming said driving gear for said driven gear.

* * * * *